US006710530B2

(12) United States Patent
Lee et al.

(10) Patent No.: US 6,710,530 B2
(45) Date of Patent: Mar. 23, 2004

(54) CATHODE RAY TUBE HAVING SHADOW MASK WITH IMPROVED SHOCK ABSORPTION EFFECT

(75) Inventors: Jun-Jong Lee, Seoul (KR); Kyou-Bong Lee, Suwon (KR); Jong-Han Rhee, Suwon (KR); Sang-Ho Jeon, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/272,001

(22) Filed: Oct. 17, 2002

(65) Prior Publication Data

US 2003/0085648 A1 May 8, 2003

(30) Foreign Application Priority Data

Nov. 2, 2001 (KR) ..... 2001-68306

(51) Int. Cl.[7] ..... H01J 29/80
(52) U.S. Cl. ..... 313/402; 313/403; 313/477
(58) Field of Search ..... 313/402, 403, 313/407, 477 R

*Primary Examiner*—Vip Patel
(74) *Attorney, Agent, or Firm*—Staas & Halsey LLP

(57) ABSTRACT

A cathode ray tube includes a panel with an inner phosphor screen, and a funnel sealed to the panel while facing the phosphor screen. The funnel is externally mounted with a deflection yoke. A neck is sealed to the rear of the funnel while mounting an electron gun to emit electron beams therein. A shadow mask is placed within the panel. The shadow mask has a hole-formation portion with a plurality of beam-guide holes, a non-holed portion externally surrounding the hole-formation portion while being shaped with a rectangular frame, and a skirt bent from the outer periphery of the non-holed portion to the rear of the panel. The skirt has a basic etching portion half-etched at a predetermined roughness. The components of the shadow mask are integrated into one body. A welding portion is formed at the bottom of the skirt with a plurality of welding points. A mask frame is internally suspension-fitted to the panel while being welded to the skirt to support the shadow mask. The skirt of the shadow mask has a subsidiary etching portion placed between the welding portion and the basic etching portion while being half-etched at a roughness greater than the roughness of the basic etching portion.

17 Claims, 7 Drawing Sheets

FIG. 2A
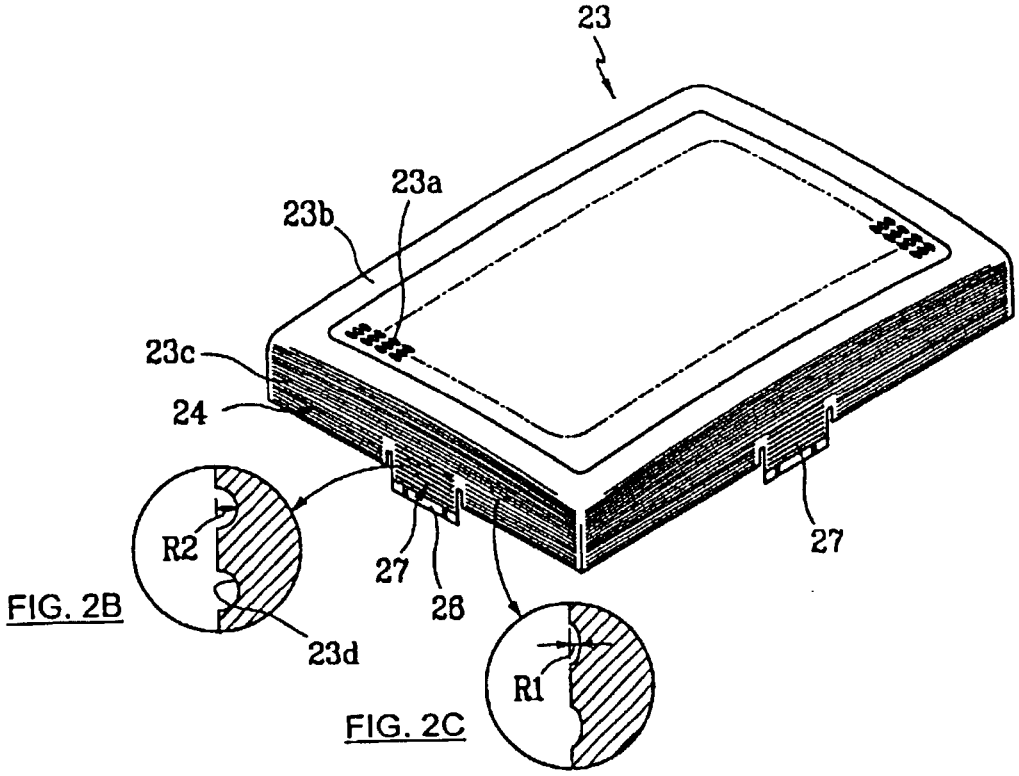
FIG. 2B
FIG. 2C
FIG. 3
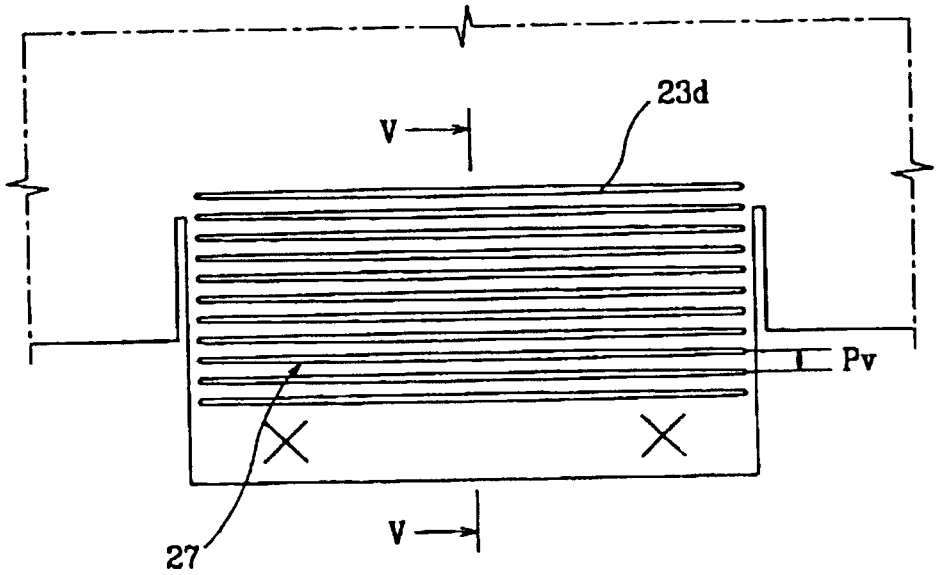

CATHODE RAY TUBE HAVING SHADOW MASK WITH IMPROVED SHOCK ABSORPTION EFFECT

CROSS-REFERENCE TO RELATED APPLICATION

This application claims the benefit of Korean Application No. 2001-68306, filed Nov. 2, 2001, in the Korean Industrial Property Office, the disclosure of which is incorporated herein by reference.

BACKGROUND OF THE INVENTION (a) Field of the Invention

The present invention relates to a cathode ray tube and, more particularly, to a cathode ray tube with a shadow mask which is free of deformation while involving improved shock absorption effect.

(b) Description of the Related Art

Generally, as shown in FIG. 11, a cathode ray tube includes a panel 101 with an inner phosphor screen 102, a funnel 103 sealed to the panel 101 while facing the phosphor screen 102, and a neck 105 sealed to the rear of the funnel 103 while mounting an electron gun 107 to emit electron beams 106 therein. A deflection yoke 109 externally surrounds the funnel 103.

A color selection member 121 called the "shadow mask" is mounted within the panel 101 such that it faces the phosphor screen 102. The electron beams emitted from the electron gun 107 are deflected by the deflection yoke 109. The electron beams then pass through the shadow mask 121, and land on the phosphor screen 102.

The shadow mask 121 has a rectangular-shaped hole formation portion 121*a* with a plurality of beam-guide holes, a non-holed portion 121*b* surrounding the hole formation portion 121*a* in the shape of a rectangular frame, and a skirt 121*c* bent from the outer periphery of the non-holed portion 121*b* to the rear of the panel 101. The respective components of the shadow mask 121 are formed in a body by way of press formation.

The skirt 121*c* of the shadow mask 121 is inserted into a mask frame 123 to thereby form a mask assembly. The mask assembly is internally suspension-fitted to the panel 101.

When the skirt 121*c* of the shadow mask 121 is inserted into the mask frame 123 while being sealed thereto, stress is made at the borderline area between the shadow mask 121 and the mask frame 123 due to the outstretching of the skirt. The stress is transmitted to the hole-formation portion 121*a* of the shadow mask 121 via the skirt 121*c* and the non-holed portion 121*b*.

With the stress, as illustrated in FIG. 12, the relatively weak periphery of the hole-formation portion 121*a* (the borderline area between the hole-formation portion 121*a* and the non-hole portion 121*b*) is sunken, and this results in curvature deformation of the shadow mask 121.

Even though such a curvature deformation of the shadow mask is not visible, it greatly affects the strength of the final product against impact, and hence, it is preferable to reduce the stress transmitted to the hole-formation portion as much as possible.

In order to prevent such a curvature deformation, it has been proposed that a plurality of notches and bead-shaped expansions should be provided in the skirt, or slits should be provided below the non-holed portion, thereby preventing the stress from being generated at the boundary of the mask frame. However, with this method, the effect of preventing the curvature deformation is not so great.

Furthermore, as the outstretching is made at the bottom of the skirt, the length of the skirt may be reduced to decrease the degree of outstretching, thereby preventing the curvature deformation. In this case, the welding point of the mask frame to the mask is heightened so that the flexibility relation between the skirt and the welding point at the possible impact of dropping is deteriorated, and this is disadvantageous in the shock absorption.

SUMMARY OF THE INVENTION

Accordingly, it is an object of the present invention to provide a cathode ray tube which enhances the stress prevention effect at the boundary of the mask frame as well as at the welding point thereof to the shadow mask where two or more half etchings differentiated in the etching roughness are made.

Additional objects and advantages of the invention will be set forth in part in the description which follows and, in part, will be obvious from the description, or may be learned by practice of the invention.

The foregoing and other objects of the present invention may be achieved by providing a cathode ray tube including: a panel with an inner phosphor screen; a funnel sealed to the panel while facing the phosphor screen, the funnel being externally mounted with a deflection yoke; a neck sealed to the rear of the funnel while mounting an electron gun to emit electron beams therein, a shadow mask placed within the panel, the shadow mask having a hole-formation portion with a plurality of beam-guide holes, a non-holed portion externally surrounding the hole formation portion while being shaped with a rectangular frame, and a skirt bent from the outer periphery of the non-holed portion to the rear of the panel, the skirt having a basic etching portion half-etched at a predetermined roughness, the components of the shadow mask being integrated into one body; a welding portion is formed at the bottom of the skirt with a plurality of welding points; and a mask frame internally suspension-fitted to the panel while being welded to the skirt to support the shadow mask, wherein the skirt of the shadow mask has a subsidiary etching portion placed between the welding portion and the basic etching portion while being half-etched at a roughness greater than the roughness of the basic etching portion.

In another aspect of the present invention, the subsidiary etching portion is formed at the central bottom portion of the skirt.

In another aspect of the present invention, the volume reduction rate per unit volume of the subsidiary etching portion by way of the half etching is greater than the volume reduction rate per unit volume of the basic etching portion. The volume reduction rate per unit volume of the subsidiary etching portion by way of the half etching is established to be in the range of 40–60%.

In yet another aspect of the present invention, a plurality of longitudinal slit-typed etching grooves are formed at the subsidiary etching portion while horizontally proceeding parallel to each other. Further, the etching grooves may be partitioned into two or more columns. In this case, it is preferable that the distance $P_c$ between the etching groove columns is established to be in constant proportion to the vertical pitch $P_v$ of the etching grooves.

In yet another aspect of the present invention, the subsidiary etching portion is formed either at the external surface of the skirt, or at the internal surface thereof. In yet another aspect of the present invention, the subsidiary etching portion may be formed both at the external surface of the skirt and at the internal surface thereof. In the latter case, the central axes of the etching grooves correspondingly formed at the internal and the external surfaces of the skirt agree to each other, or are deviated from each other by a predetermined distanced. In yet another aspect of the present invention, a width of each groove on one surface of the mask skirt may be narrower than that of the other surface of the mask skirt.

The foregoing and other objects of the present invention may also be achieved by providing a cathode ray tube including: a panel with an inner phosphor screen; a funnel sealed to the panel while facing the phosphor screen, the funnel being externally mounted with a deflection yoke; a neck sealed to the rear of the funnel while mounting an electron gun to emit electron beams therein; a shadow mask placed within the panel, the shadow mask having a hole-formation portion with a plurality of beam-guide holes, a non-holed portion externally surrounding the hole-formation portion while being shaped with a rectangular frame, and a skirt bent from the outer periphery of the non-holed portion to the rear of the panel, the components of the shadow mask being integrated into one body, and a mask frame internally suspension-fitted to the panel while being welded to the skirt to support the shadow mask, wherein the skirt of the shadow mask is formed using two or more half etchings differentiated in the etching roughness.

In an aspect of the present invention, the skirt of the shadow mask may be formed by way of the half etching such that the etching roughness at the bottom side of the skirt is greater than the etching roughness at the top of the skirt.

BRIEF DESCRIPTION OF THE DRAWINGS

These and other objects and advantages of the invention will become apparent and more readily appreciated from the following description of the embodiments, taken in conjunction with the accompanying drawings of which:

FIG. 2A is a perspective view of the shadow mask illustrated in FIG. 1;

FIGS. 2B and 2C are enlarged views of the welding portion and the basic etching portion of the skirt illustrated in FIG. 1;

FIG. 3 is a partial side view of a shadow mask skirt illustrating a slit-type half etching;

DETAILED DESCRIPTION OF THE PREFERRED EMBODIMENTS

Figure 1:
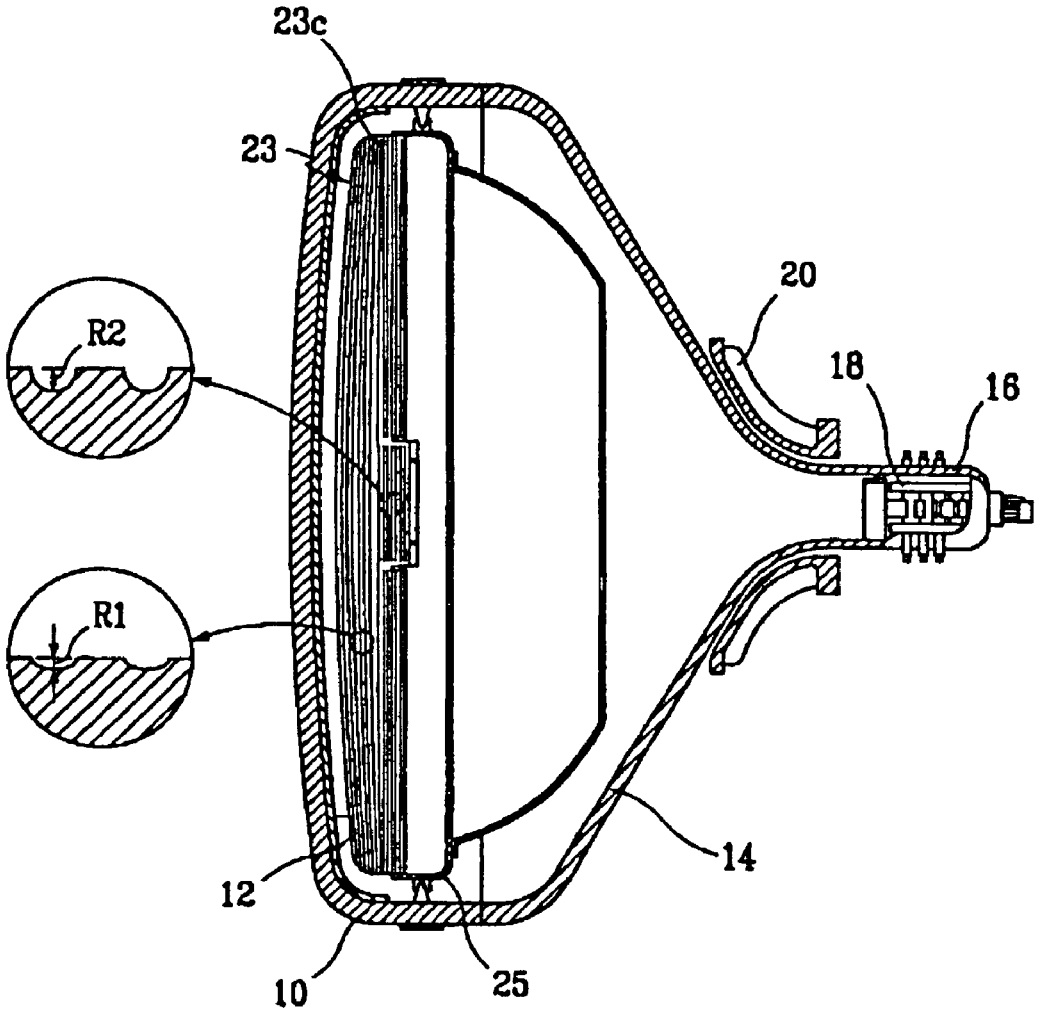
FIG. 1 is a cross sectional view of a cathode ray tube with a shadow mask according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

FIG. 1 is a cross sectional view of a cathode ray tube with a shadow mask according to an embodiment of the present invention, and FIG. 2A is a perspective view of the shadow mask illustrated in FIG. 1.

As illustrated in FIG. 1, the cathode ray tube includes a panel 10 with an inner phosphor screen 12, a funnel 14 sealed to the panel 10 while facing the phosphor screen 12, and a neck 16 sealed to the rear of the funnel 14 while mounting an electron gun 18 therein.

A mask frame 25 is internally suspension-fitted to the panel 10, and a shadow mask 23 is welded to the mask frame 25 by way of a bottom welding portion 26 with a plurality of welding points. The shadow mask 23 is provided with a hole-formation portion 23*a*, a non-holed portion 23*b*, and a skirt 23*c*. The respective components of the shadow mask 23 are formed in a body of the shadow mask 23.

As illustrated in FIG. 2A, the skirt 23*c* of the shadow mask 23 is bent from the outer periphery of the non-holed portion 23*b* to the rear of the panel 10. The skirt 23*c* has a basic etching portion 24 half-etched at a predetermined roughness, and a subsidiary etching portion 27 placed between the welding portion 26 and the basic etching portion 24.

As shown in FIGS. 2A through 2C, the etching roughness of the subsidiary etching portion 27 is established to be higher than that related to the basic etching portion 24. The subsidiary etching portion 27 is placed at the central bottom of the skirt 23*c*. The basic etching portion 24 and the subsidiary etching portion 27 have etching grooves, and the depths of the etching grooves in the two different etching portions 24 and 27 are indicated by $R_1$ and $R_2$. The difference in the etching roughness may be represented by the relation of $R_2>R_1$.

The etching roughness may be defined by the volume reduction rate per unit volume by way of the etching while being determined dependent upon the shape, width, depth and pitch of the etching groove or slit.

Particularly, the skirt 23*a* is formed such that the volume reduction rate per unit volume of the subsidiary etching portion 27 by way of the half etching is greater than that of the basic etching portion 24. Preferably, when the volume reduction rate per unit volume by way of the usual half etching is assumed to be in the range of 4–15%, the volume reduction rate per unit volume of the subsidiary etching portion 27 is established to be in the range of 40–60%.

When the volume reduction rate per unit volume of the subsidiary etching portion 27 is 40% or less, it becomes difficult to achieve the desirable effect compared to other portions. When the volume reduction rate is 60% or more, the shadow mask is liable to be broken during the formation.

In the case of a dot-type half etching, the volume reduction rate per unit volume by way of the half etching can be expressed by the mathematical formula 1.

$$\frac{\left(\frac{4}{3}\pi r^3\right)\Big/2}{P_h^2 \times t} \tag{1}$$

where r indicates the dot radius, $P_h$ the pitch, and t the thickness of the shadow mask.

For instance, in the case of a 17" CDT, when r=0.075 mm, $P_h$=0.15 mm and t=0.12 mm, the volume reduction rate per unit volume is established to be about 14.7%.

With the embodiments of present invention, the subsidiary etching portion 27 of the skirt 23*c* is negatively affected in the half etching where the volume reduction rate per unit volume is increased up to the level of not bearing the breakage problem during the formation so that it can work as a shock absorption region for the skirt 23*a*.

Figure 4:
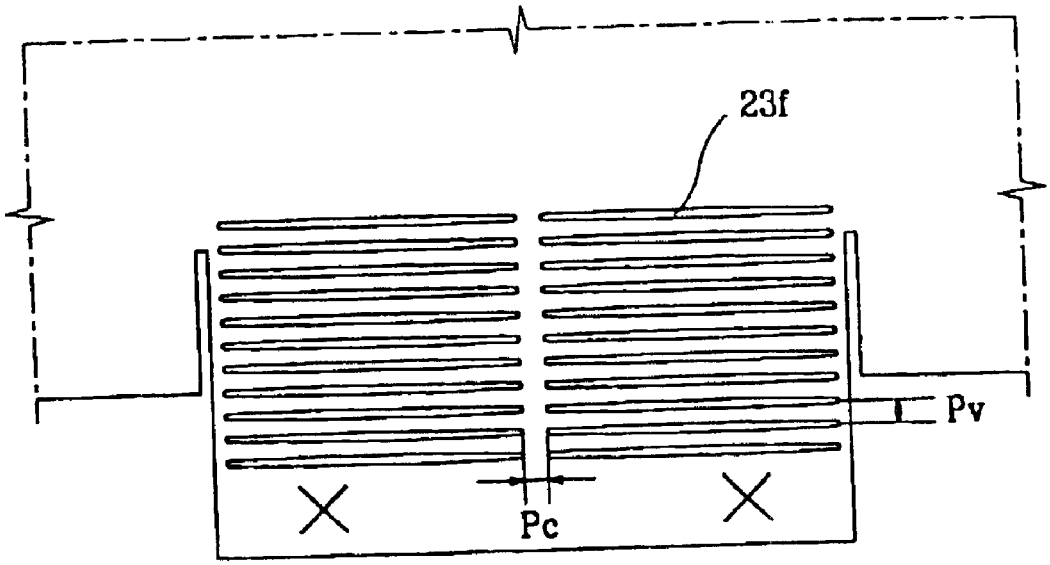
FIG. 4 is a partial side view of a shadow mask skirt illustrating another slit-type half etching.

FIG. 3 is a partial side view illustrating a slit-type half etching applied to the skirt of the shadow mask, and FIG. 4 illustrates another slit-type half etching applied thereto.

As illustrated in FIG. 3, the slit-type half etching may be applied particularly to the subsidiary etching portion 27 of the skirt. With the half etching, a plurality of longitudinal slit-type etching grooves are formed while horizontally proceeding parallel to each other.

As illustrated in FIG. 3, a plurality of mono slit-type etching grooves 23*d* are formed while proceeding parallel to each other with a predetermined vertical pitch $P_v$. As illustrated in FIG. 4, it is possible that a plurality of slit-type etching grooves 23*f* may be formed parallel to each other while being partitioned into two or more columns. It is preferable that the inter-column distance $P_c$ should be established to be in constant proportion to the vertical pitch $P_v$.

Figure 5:
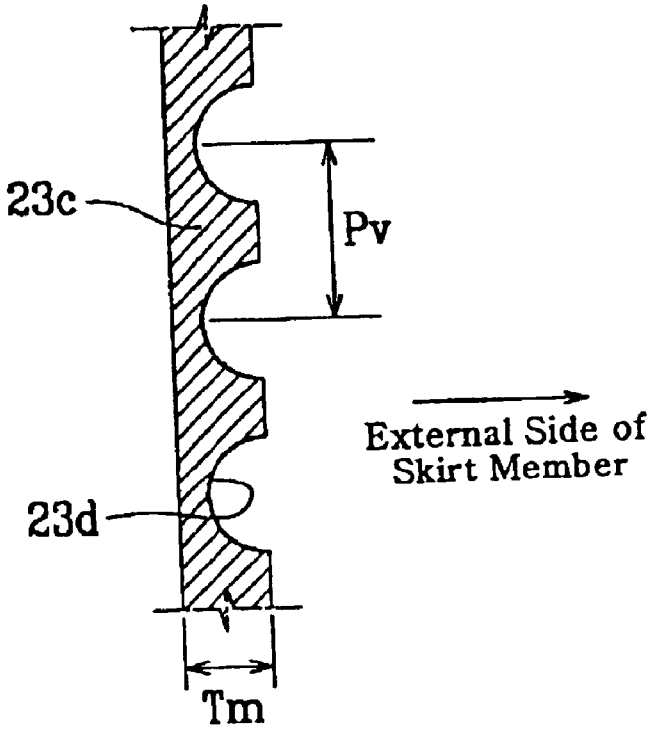
FIG. 5 is a partial sectional view of the shadow mask skirt taken along the V—V line of FIG. 3.

FIG. 5 is a cross sectional view of the shadow mask skirt taken along the V—V line of FIG. 3, and FIGS. 6 to 9 are partial sectional views of shadow mask skirts where various kinds of slit-typed half etchings are applied.

As illustrated in FIG. 5, the etching grooves 23*d* may be formed at the external surface of the shadow mask skirt 23*c* with a predetermined vertical pitch $P_v$. Particularly, it is preferable that a subsidiary etching portion where the etching roughness is greater than that of the basic etching portion is positioned between the welding portion of the skirt 23*c* and the basic etching portion.

Figure 6:
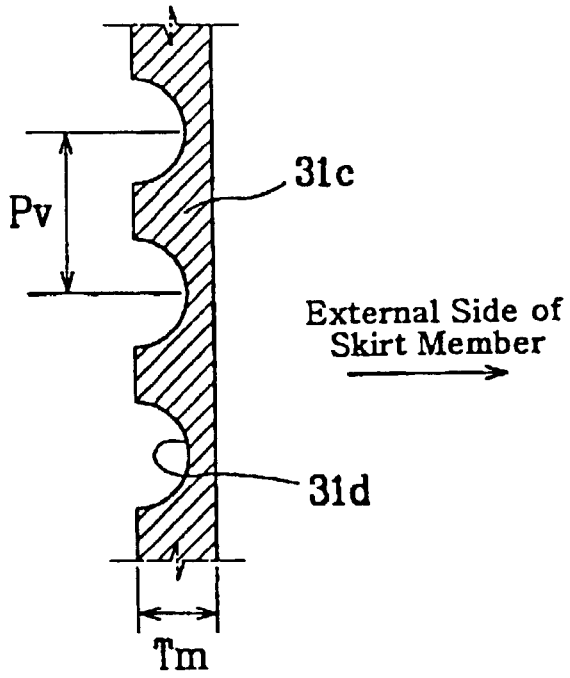
FIGS. 6 to 9 are partial sectional views of shadow mask skirts illustrating various types of half etchings.

Alternatively, as illustrated in FIG. 6, the etching grooves 31*d* by way of the half etching may be formed at the internal surface of the skirt 31*c* with a predetermined vertical pitch $P_v$. Particularly, it is preferable that a subsidiary etching portion where the etching roughness is greater than the basic etching portion is formed between the welding portion of the skirt 31*c* and the basic etching portion.

Figure 7:
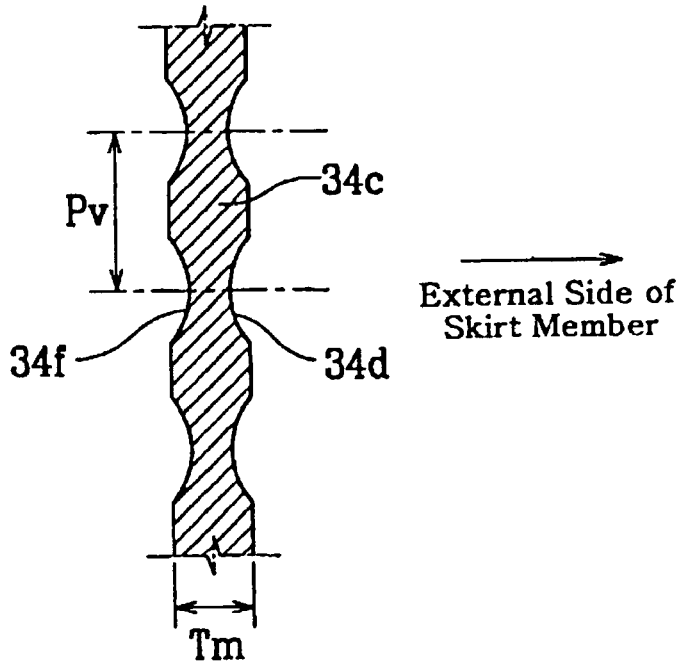
Figure 8:
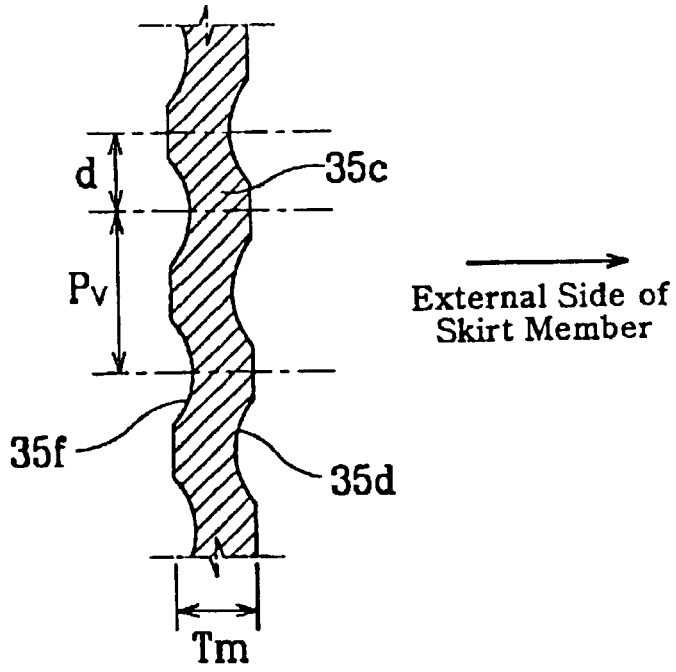
Figure 9:
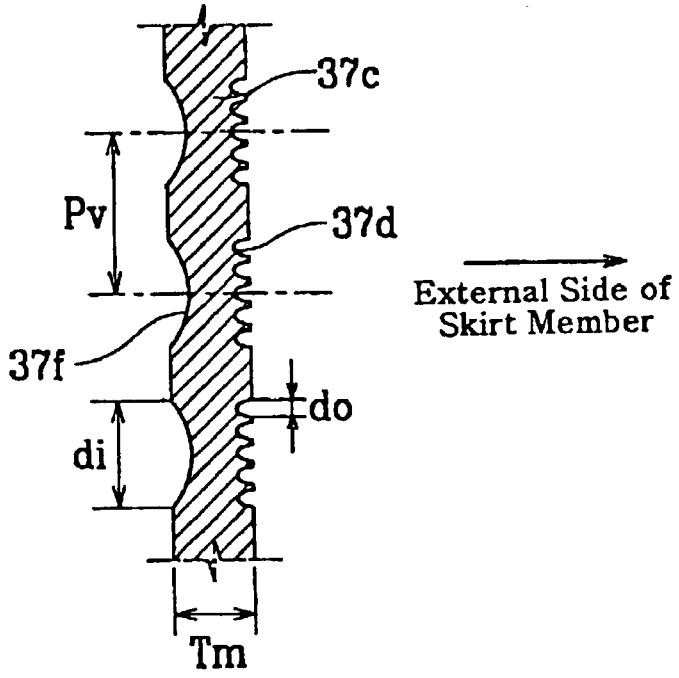

Furthermore, as illustrated in FIGS. 7 to 9, the etching grooves by way of the half etching may be formed at the internal surface of the skirt as well as at the external surface thereof with a predetermined vertical pitch $P_v$. Particularly, it is preferable that a subsidiary etching portion where the etching roughness is greater than that of the basic etching portion is formed between the welding portion of the skirt and the basic etching portion.

As illustrated in FIG. 7, the etching grooves 34*d* and 34*f*, formed at the external and internal surfaces of the skirt 34*c* while corresponding to each other, are established such that the central axes thereof agree with each other.

As in FIG. 8, the etching grooves 35*d* and 35*f* formed at the external and internal surfaces of the skirt 35*c*, while corresponding to each other, are established such that the central axes thereof are deviated from each other by a predetermined distance d.

As illustrated in FIG. 9, the etching groove 37*d* formed at the external surface of the skirt 37*c* is established to bear a first width $d_0$, and those 37*f* formed at the internal surface of the skirt 37*c* to bear a second width $d_l$, narrower than the first width $d_0$ such that a one-to-many correspondence relation is made between the internal and the external etching grooves 37*f* and 37*d*. Alternatively, the one to many correspondence relation may be made in a reverse order, that is, between the external and the internal etching grooves 37*d* and 37*f* while being differentiated in the width thereof.

In the drawings, the reference numeral Tm indicates the thickness of the shadow mask skirt.

Meanwhile, in case the slit-type half etching is applied to the subsidiary etching portion of the skirt, the basic etching portion may suffer a slit-type half etching where the etching roughness is smaller than that of the subsidiary etching portion. Alternatively, the etching grooves may be formed by way of a dot-type half etching.

Figure 10:
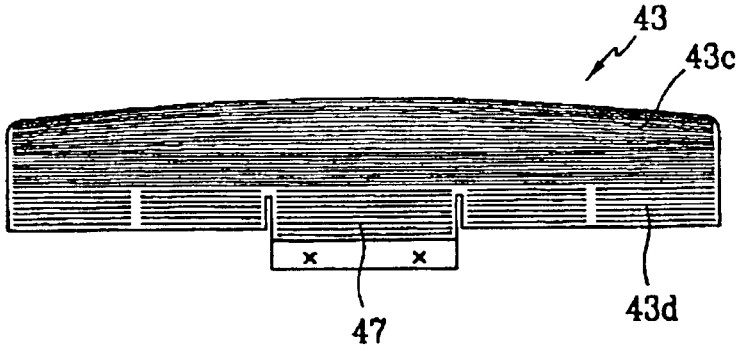
FIG. 10 is a side view of a shadow mask according to another embodiment of the present invention.
Figure 11:
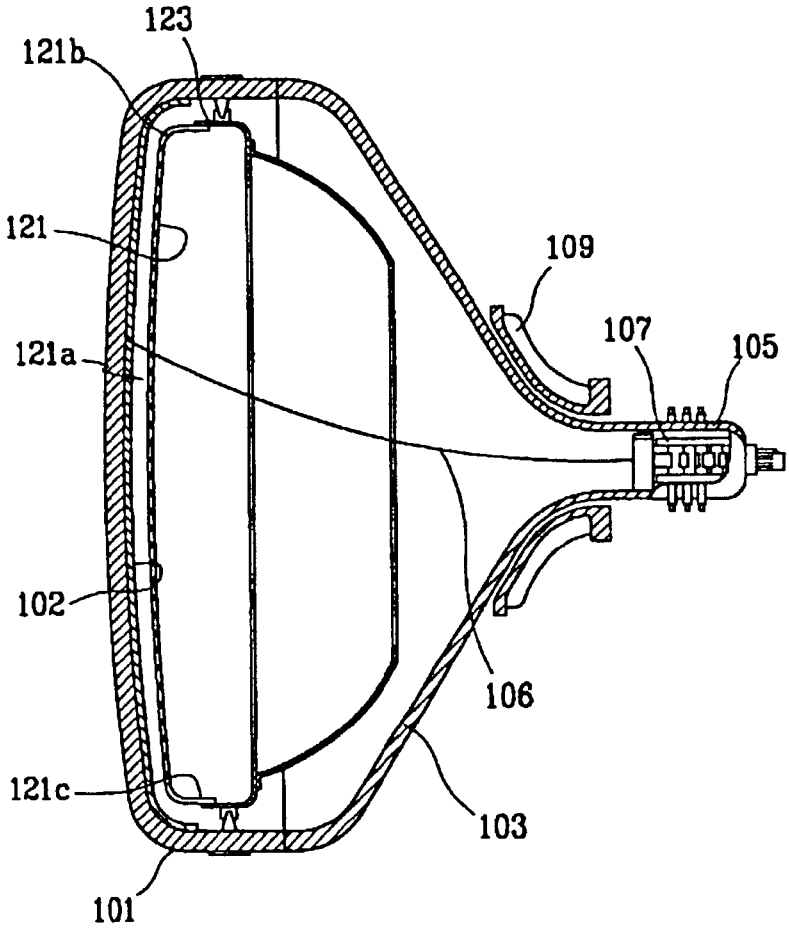
FIG. 11 (PRIOR ART)
FIG. 11 is a cross sectional view of a conventional cathode ray tube with a shadow mask.
Figure 12:
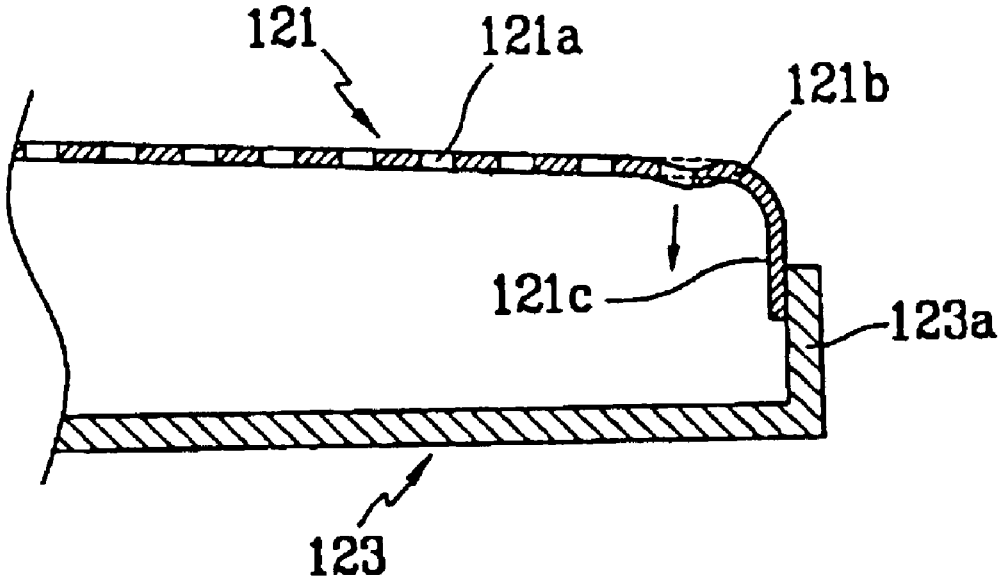
FIG. 12 (PRIOR ART)
FIG. 12 is a partial amplified view of the cathode ray tube illustrated in FIG. 11 where the shadow mask is fitted to a mask frame.

FIG. 10 is a side view of a shadow mask according to another preferred embodiment of the present invention.

As illustrated in FIG. 10, the shadow mask skirt 43*c* is provided with a subsidiary etching portion 47 positioned at the bottom side thereof where the etching roughness is greater than that of the top.

A longitudinal slit-type etching groove 43*d* may be formed at the bottom side of the skirt 43*c* by way of the slit-type half etching. For instance, a plurality of mono slit-type etching grooves are formed while proceeding parallel to each other by a predetermined vertical pitch, or a plurality of slit-type etching grooves are formed parallel to each other while being partitioned into two or more columns. In the latter case, the inter-column distance may be established to be in constant proportion to the vertical pitch.

Furthermore, the etching groove 43*d* may be formed either at the internal or at the external surface of the skirt 43*c*, or both at the internal and at the external surfaces thereof. In the latter case, the central axes of the etching grooves correspondingly formed at the internal and external surfaces of the skirt may agree with each other, or deviate from each other by a predetermined distance.

As with the bottom side of the skirt 43*c*, the slit-type half etching may be applied to the top thereof to form a longitudinal slit-type etching groove there. Alternatively, a dot-type half etching may be applied thereto to form a dot-type etching groove there. It is preferable that the etching roughness related to the top side of the skirt should be established to be relatively small compared to that related to the bottom thereof.

An impact test was made with respect to 19" color display tubes (CDTs), and the result is illustrated in Table 1. In the test, the slit-type half etching illustrated in FIG. 9 was applied to the subsidiary etching portion of the shadow mask skirt. The volume reduction rate per unit volume by way of the half etching is established to be about 56.8%.

In Table 1, G indicates the acceleration degree corresponding to the degree of impact. For instance, when the terrestrial gravitation close to the earth surface is indicated by 1G, at least a gravitation of 20G is required for the 19" CDT. As the value of G is increased, the strength of the target object against impact is enhanced.

TABLE 1

| | Prior art | Present invention |
|---|---|---|
| Example 1 | 21.5 G's | 31.1 G's |
| Example 2 | 22.5 G's | 29.8 G's |
| Example 3 | 22.3 G's | 30.4 G's |
| Example 4 | 21.9 G's | 30.7 G's |
| Average | 22.1 G's | 30.5 G's |

It can be estimated from Table 1 that the strength of the target object against impact in Examples 1 to 4 under the application of the half etching is very high compared to the prior art-based cases.

As described above, with the cathode ray tube having a half-etched shadow mask, a subsidiary etching portion is provided between the welding portion of the skirt and the basic etching portion. The subsidiary etching portion involves an etching roughness greater than that related to the basic etching portion so that the possible stress at the boundary of the mask frame as well as at the welding portion thereof to the mask is prohibited, thereby preventing deformation in the curvature of the hole-formation portion of the shadow mask.

In addition, the curvature at the borderline area between the hole-formation portion of the shadow mask and the non-holed portion thereof is stabilized, thereby enhancing the strength thereof against impact such as dropping.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A cathode ray tube comprising:

a panel having an inner phosphor screen;

a funnel sealed to the panel while facing the phosphor screen, the funnel being externally mounted with a deflection yoke;

a neck sealed to the rear of the funnel while mounting an electron gun to emit electron beams therein;

a shadow mask placed within the panel, the shadow mask having a hole-formation portion with a plurality of beam-guide holes, a non-holed portion externally surrounding the hole-formation portion while being shaped with a rectangular frame, and a skirt bent from the outer periphery of the non-holed portion to the rear of the panel, the skirt having a basic etching portion half-etched at a predetermined roughness, the components of the shadow mask being integrated into one body;

a welding portion formed at the bottom of the skirt with a plurality of welding points; and a mask frame internally suspension-fitted to the panel while being welded to the skirt to support the shadow mask;

wherein the skirt of the shadow mask has a subsidiary etching portion placed between the welding portion and the basic etching portion while being half-etched at a roughness greater than the roughness of the basic etching portion.

2. The cathode ray tube of claim 1, wherein the subsidiary etching portion is formed at a central bottom portion of the skirt.

3. The cathode ray tube of claim 1, wherein a volume reduction rate per unit volume of the subsidiary etching portion due to the half etching is greater than a volume reduction rate per unit volume of the basic etching portion.

4. The cathode ray tube of claim 3, wherein the volume reduction rate per unit volume of the subsidiary etching portion due to the half etching is in the range of 40–60%.

5. The cathode ray tube of claim 1, wherein the subsidiary etching portion comprises a plurality of longitudinal slit-typed etching grooves which are horizontally parallel to each other.

6. The cathode ray tube of claim 5, wherein the etching grooves are partitioned into two or more columns.

7. The cathode ray tube of claim 6, wherein a distance between the etching groove columns is in direct proportion to a vertical pitch of the etching grooves.

8. The cathode ray tube of claim 1, wherein the subsidiary etching portion is formed at an external surface of the skirt opposite the mask frame.

9. The cathode ray tube of claim 1, wherein the subsidiary etching portion is formed at an internal surface of the skirt not opposite the mask frame.

10. The cathode ray tube of claim 1, wherein the subsidiary etching portion is formed at an internal surface of the skirt and at an external surface of the skirt.

11. The cathode ray tube of claim 10, wherein central axes of corresponding pairs of the etching grooves at the internal and the external surfaces of the skirt are coincident with each other.

12. The cathode ray tube of claim 10, wherein central axes of the etching grooves correspondingly formed at the internal and the external surfaces of the skirt are offset from each other by a predetermined distance d.

13. The cathode ray tube of claim 10, wherein a width of each etched groove on one surface of the mask skirt is narrower than each etched groove of another surface of the mask skirt.

14. A cathode ray tube comprising:

a panel with an inner phosphor screen;

a funnel sealed to the panel while facing the phosphor screen, the funnel being externally mounted with a deflection yoke;

a neck sealed to a rear of the funnel while mounting an electron gun to emit electron beams therein;

a shadow mask placed within the panel, the shadow mask having a hole-formation portion with a plurality of beam-guide holes, through which the electron beams pass a non-holed portion externally surrounding the hole-formation portion while being shaped with a rectangular frame, and a skirt bent from an outer periphery of the non-holed portion to a rear of the panel, the components of the shadow mask being integrated into one body; and a mask frame internally suspension-fitted to the panel while being welded to the skirt to support the shadow mask;

wherein the skirt of the shadow mask comprises two or more half etchings having corresponding different etching roughness.

15. The cathode ray tube of claim 14, wherein the skirt of the shadow mask is formed by way of the half etching such that the etching roughness at a bottom side of the skirt is greater than the etching roughness at a top of the skirt.

16. The cathode ray tube according to claim 1, wherein the etching is formed by dot-type half etching, and a volume reduction rate per unit volume due to the half etching is expressed by:

$$\frac{\left(\frac{4}{3}\pi r^3\right)/2}{P_h^2 \times t}$$

where r indicates the dot radius, $P_h$ a pitch, and t a thickness of the shadow mask.

17. A cathode ray tube comprising:

a panel with an inner phosphor screen;

a funnel sealed to the panel and facing the phosphor screen, the funnel having an external deflection yoke mounted thereon;

a neck sealed to a rear of the funnel and having an electron gun mounted thereto to emit electron beams into the funnel;

a shadow mask positioned within the panel, the shadow mask including:

a hole-formation portion with a plurality of beam-guide holes;

a non-holed portion externally surrounding the hole-formation portion; and a skirt bent from an outer periphery of the non-holed portion to a rear of the panel; and a mask frame internally suspension-fitted to the panel while connected to the skirt to support the shadow mask;

wherein the skirt of the shadow mask comprises two or more half etchings having corresponding different etching roughness.

* * * * *